US011873655B2

(12) United States Patent
Brawner

(10) Patent No.: US 11,873,655 B2
(45) Date of Patent: Jan. 16, 2024

(54) BARBED WIRE INSTALLATION APPARATUS

(71) Applicant: Eddie Brawner, Westmoreland, TN (US)

(72) Inventor: Eddie Brawner, Westmoreland, TN (US)

( * ) Notice: Subject to any disclaimer, the term of this patent is extended or adjusted under 35 U.S.C. 154(b) by 511 days.

(21) Appl. No.: 17/218,397

(22) Filed: Mar. 31, 2021

(65) Prior Publication Data

US 2022/0316235 A1 Oct. 6, 2022

(51) Int. Cl.
*E04H 17/26* (2006.01)

(52) U.S. Cl.
CPC ..... *E04H 17/266* (2013.01); *B65H 2403/544* (2013.01); *B65H 2701/363* (2013.01); *B65H 2701/364* (2013.01)

(58) Field of Classification Search
CPC ..... E04H 17/045; E04H 17/26; E04H 17/266; E04H 17/268; B65H 2701/363; B65H 2701/364
USPC ..... 140/59, 69, 107, 108
See application file for complete search history.

(56) References Cited

U.S. PATENT DOCUMENTS 3,934,655 A * 1/1976 Whistle ..... E04H 17/261 173/28
4,775,114 A * 10/1988 Farnsworth ..... B65H 49/32 256/2
4,854,521 A 8/1989 Farnsworth
4,925,435 A * 5/1990 Linklater ..... B65H 49/34 180/53.6
5,582,216 A * 12/1996 Smith ..... B21F 33/00 140/16
5,632,470 A 5/1997 Leland
5,904,314 A * 5/1999 Babcock, Jr. ..... E04H 17/266 242/566
6,042,046 A 3/2000 Beyer
6,065,714 A * 5/2000 Fondacaro ..... E04H 17/266 242/594.6
7,011,269 B1 3/2006 Chouinard
7,185,839 B2 3/2007 Albritton
11,214,978 B2 * 1/2022 McConnell ..... E04H 17/02
11,732,499 B2 * 8/2023 Weston ..... B65H 57/16 29/446
11,739,558 B1 * 8/2023 Acacio ..... B65H 57/16 29/897.3

* cited by examiner

*Primary Examiner* — Edward T Tolan

(57) ABSTRACT

A barbed wire installation apparatus for easily installing barbed wire includes a hitch bracket to selectively engage a hitch receiver of a vehicle. A horizontal cross member is coupled to the hitch bracket. A plurality of cradle arms is coupled to the cross member. A pair of spindles is coupled to the plurality of cradle arms to secure a roll of barbed wire. A pair of upright members is coupled to the cross member. A winch is coupled to the hitch bracket and has a cable in operational communication with a topmost pulley of a plurality of pulleys coupled to the pair of upright members. A control box is coupled to the pair of upright members. A wire gripper is coupled to the winch. The wire gripper is in operational communication with a distal end of the cable to secure the barbed wire.

10 Claims, 7 Drawing Sheets

BARBED WIRE INSTALLATION APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to barbed wire installation devices and more particularly pertains to a new barbed wire installation device for easily installing barbed wire. The present device includes a plurality of fixed pulleys at varied heights to allow for easy height adjustment without adjustment of the device itself.

(2) Description of Related Art Including Information Disclosed Under 37 CFR 1.97 and 1.98

The prior art relates to barbed wire installation devices. Known devices include multiple strands of barbed wire simultaneously engaged with multiple pulleys. Other known devices include a single, adjustable height pulley that is manipulated before each strand is applied.

BRIEF SUMMARY OF THE INVENTION

An embodiment of the disclosure meets the needs presented above by generally comprising a hitch bracket configured to be selectively engageable with a hitch receiver of a vehicle. A horizontal cross member is coupled to the hitch bracket and is oriented perpendicularly to the hitch bracket. The cross member has a cross top side, a cross bottom side, a cross left end, a cross right end, a cross front side, and a cross back side. A plurality of cradle arms is coupled to the cross member. The plurality of cradle arms extends above the cross top side. The plurality of cradle arms includes a left pair of cradle arms and a right pair of cradle arms. A pair of spindles is coupled to the plurality of cradle arms. The pair of spindles includes a left spindle and a right spindle rotatably coupled to the left pair of cradle arms and the right pair of cradle arms, respectively. Each spindle is configured to secure a roll of barbed wire. A pair of upright members is coupled to the cross member. The pair of upright members is coupled to the cross top side. A plurality of pulleys is coupled to the pair of upright members. A winch is coupled to the hitch bracket. The winch has a motor and a cable. The cable is in operational communication with a topmost pulley of the plurality of pulleys and one of the other pulleys of the plurality of pulleys. A control box is coupled to the pair of upright members. The control box is in operational communication with the motor of the winch and is configured to be in operational communication with a battery of the vehicle. A wire gripper is coupled to the winch. The wire gripper is in operational communication with a distal end of the cable and is configured to secure the barbed wire.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
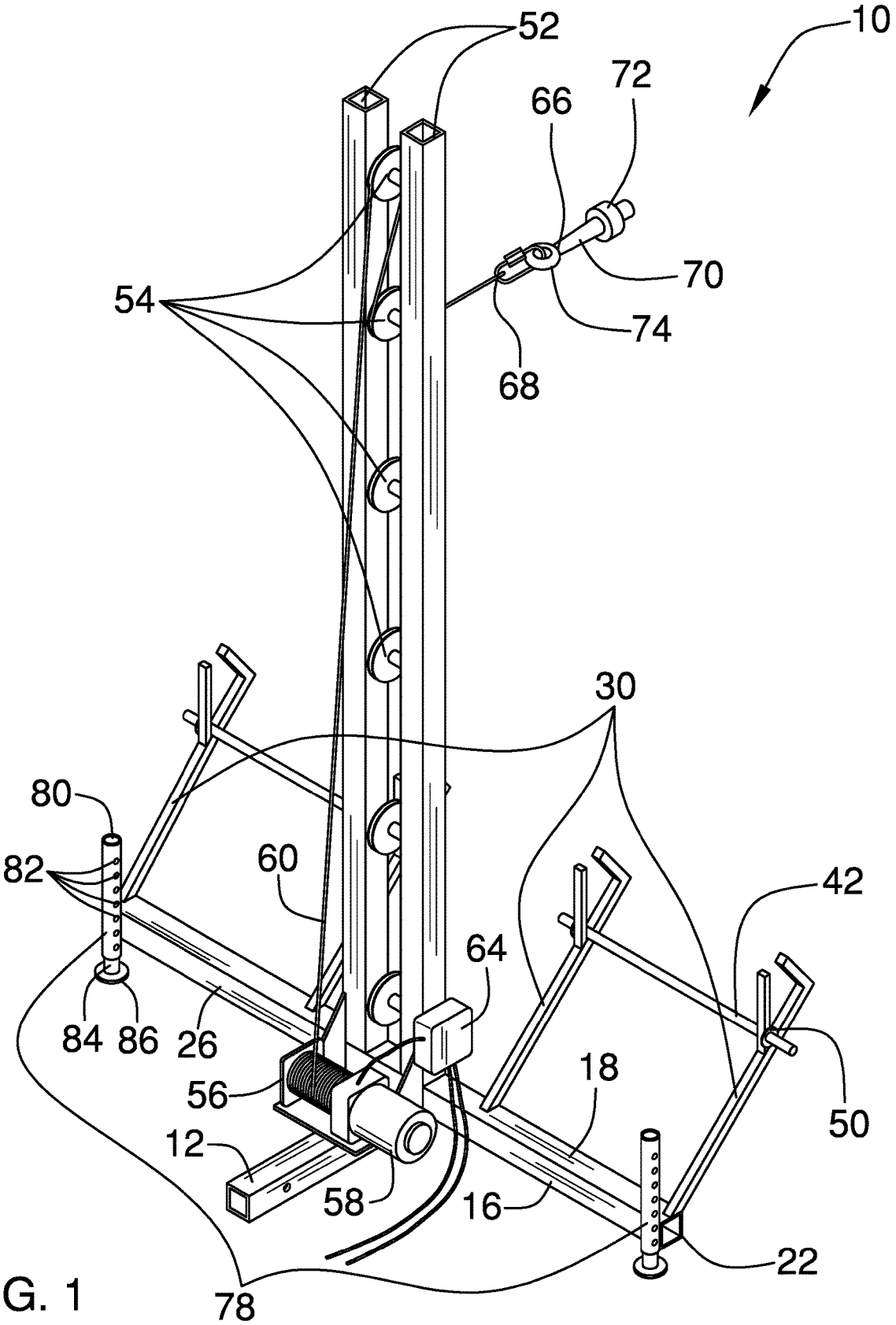
FIG. 1 is an isometric view of a barbed wire installation apparatus according to an embodiment of the disclosure.

With reference now to the drawings, and in particular to FIGS. 1 through 7 thereof, a new barbed wire installation device embodying the principles and concepts of an embodiment of the disclosure and generally designated by the reference numeral 10 will be described.

As best illustrated in FIGS. 1 through 7, the barbed wire installation apparatus generally comprises a hitch bracket 12 configured to be selectively engageable with a hitch receiver of a vehicle 14. A horizontal cross member 16 is coupled to the hitch bracket 12 and is oriented perpendicularly to the hitch bracket 12. The cross member 16 has a cross top side 18, a cross bottom side 20, a cross left end 22, a cross right end 24, a cross front side 26, and a cross back side 28. The cross top side 18 may be coupled on the hitch bracket 12.

Figure 2:
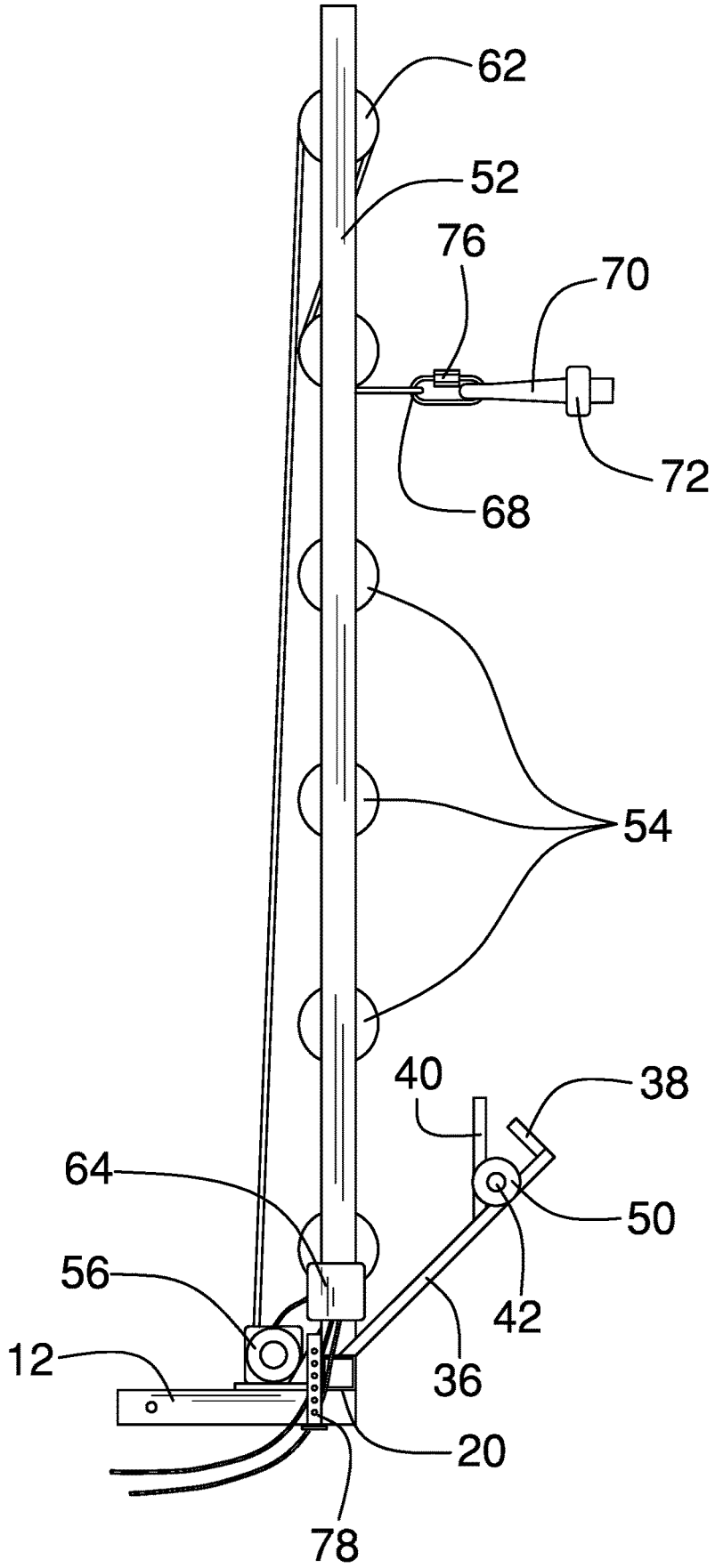
FIG. 2 is a side elevation view of an embodiment of the disclosure.
Figure 3:
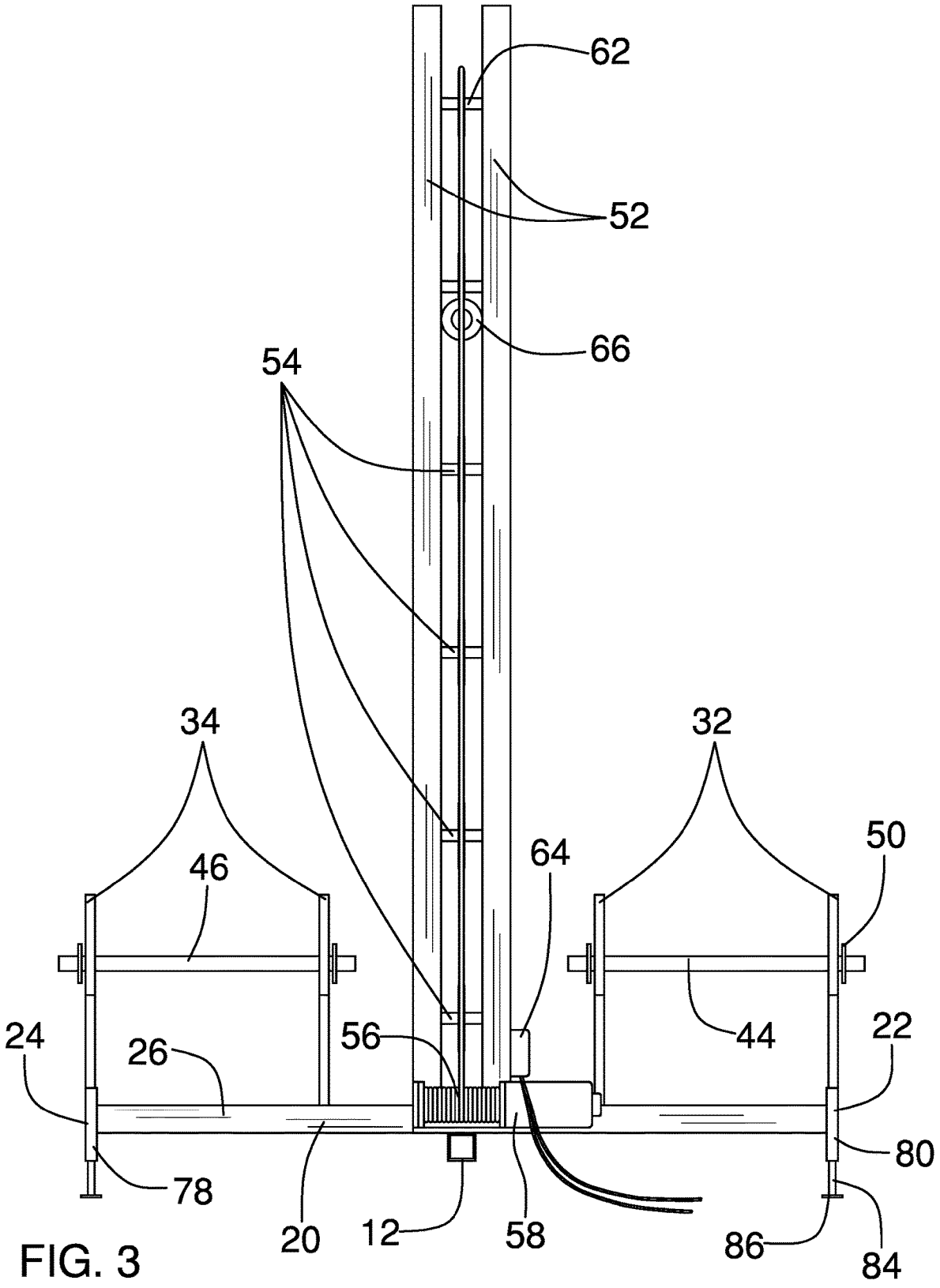
FIG. 3 is a front elevation view of an embodiment of the disclosure.
Figure 4:
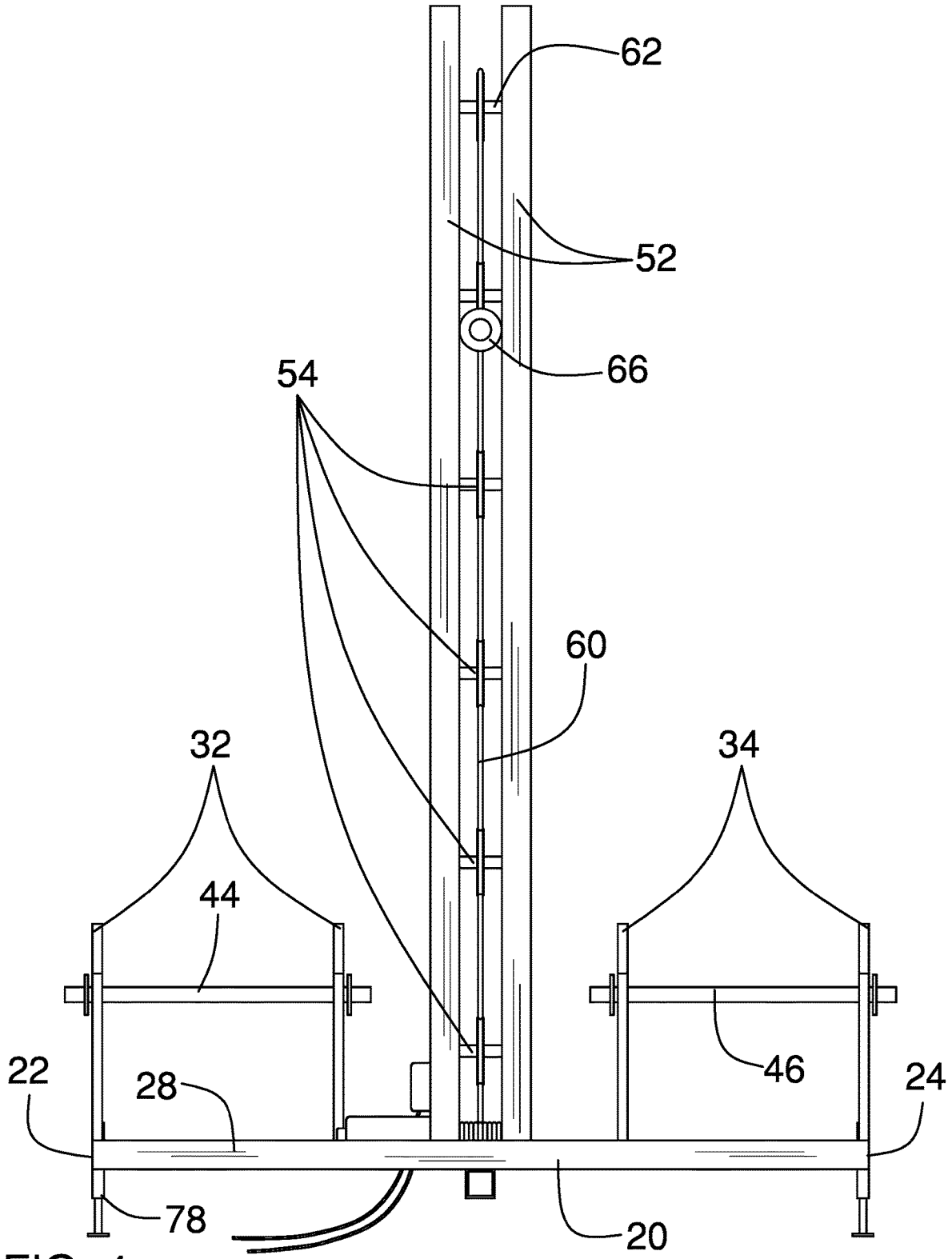
FIG. 4 is a rear view of an embodiment of the disclosure.
Figure 5:
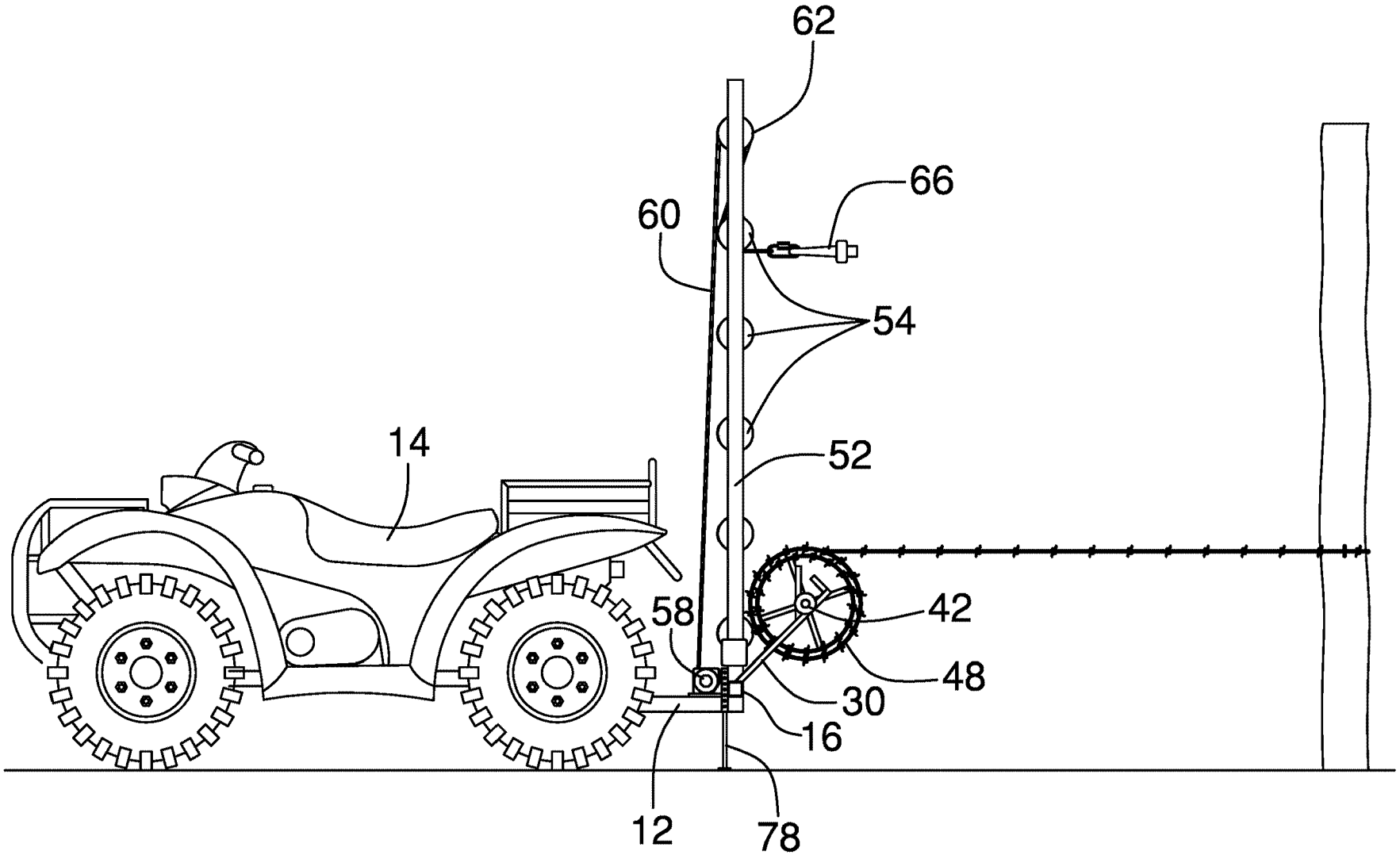
FIG. 5 is an in-use view of an embodiment of the disclosure.
Figure 6:
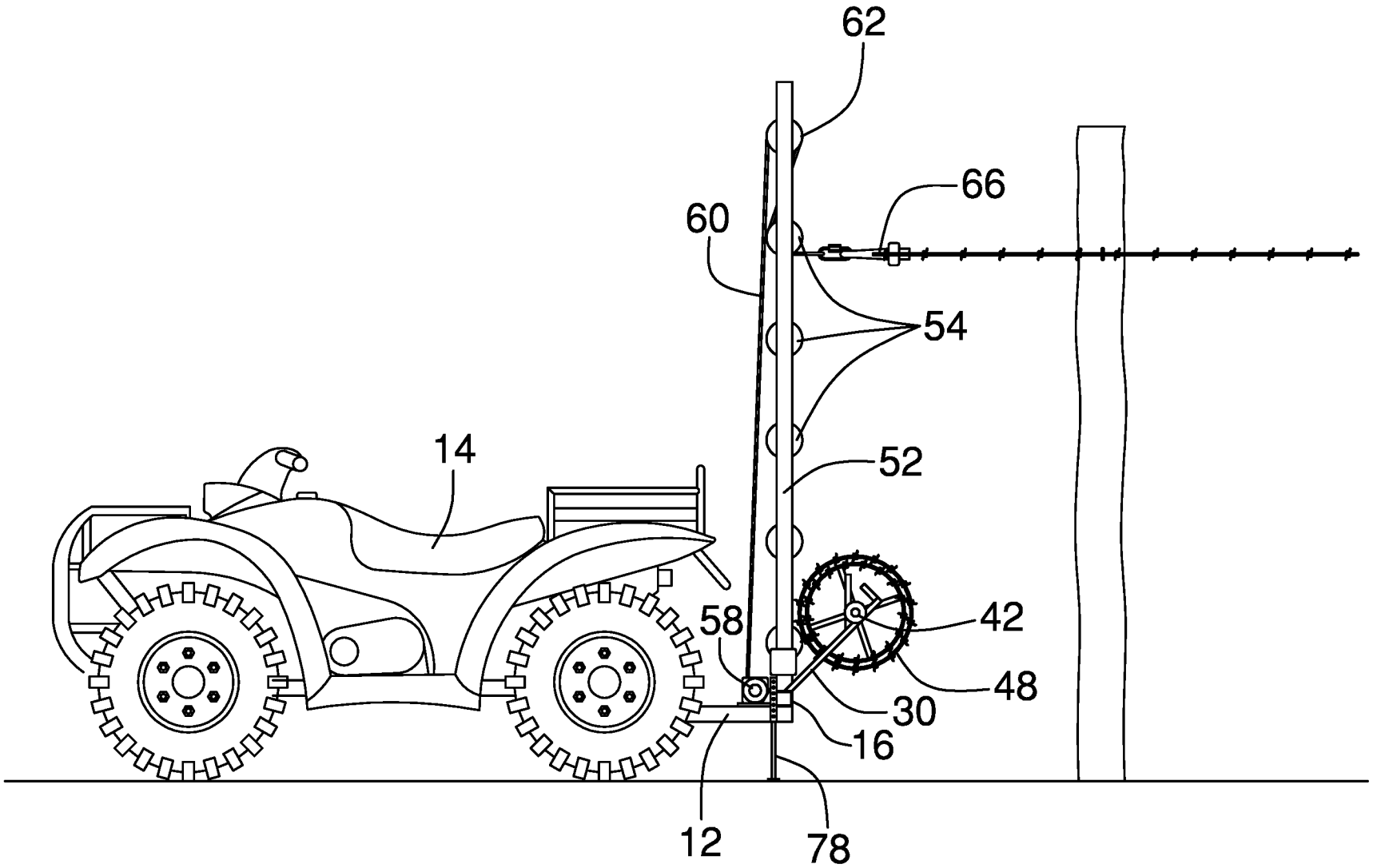
FIG. 6 is an in-use view of an embodiment of the disclosure.
Figure 7:
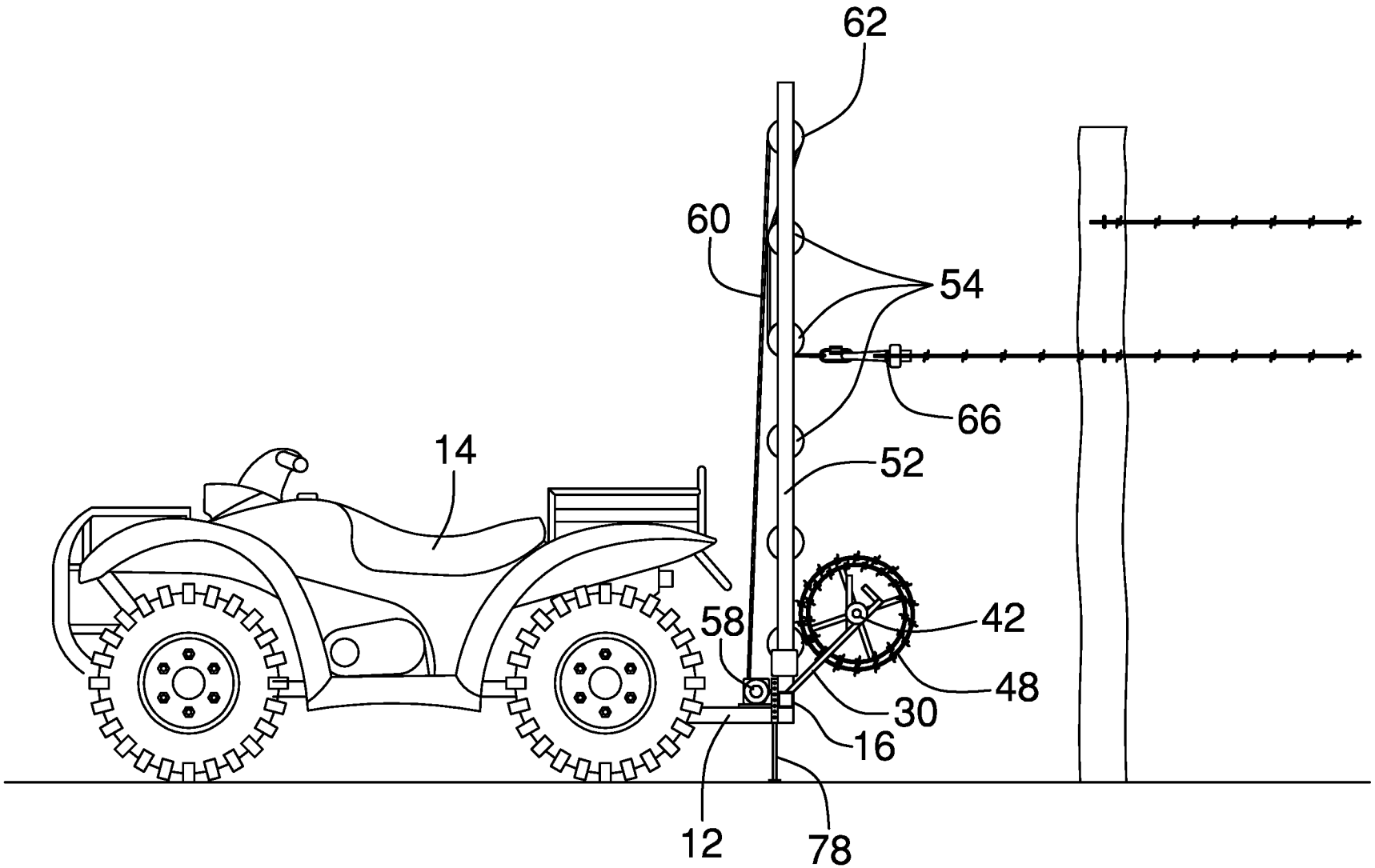
FIG. 7 is an in-use view of an embodiment of the disclosure.

A plurality of cradle arms 30 is coupled to the cross member 16. The plurality of cradle arms 30 extends above the cross top side 18. The plurality of cradle arms 30 includes a left pair of cradle arms 32 and a right pair of cradle arms 34. Each cradle arm 30 has an extension portion 36 extending at an angle from the cross top side 18, an end portion 38 oriented perpendicularly to the extension portion 36, and a stopper portion 40 extending vertically from the extension portion 36. The stopper portion 40 may extend above the end portion 38 as shown in FIG. 2. The extension portion 36 may be oriented between 30° and 60° to horizontal.

A pair of spindles 42 is coupled to the plurality of cradle arms 30. The pair of spindles 42 includes a left spindle 44 and a right spindle 46 rotatably coupled to the left pair of cradle arms 32 and the right pair of cradle arms 34, respectively. Each spindle 42 is configured to secure a roll of barbed wire 48. Each spindle 42 is selectively engageable between the end portion 38 and the stopper portion 40 and rests on the extension portion 36. Each spindle 42 may include a pair of stopper discs 50. The pair of stopper discs 50 is positioned to rest outside of the stopper portions 40 of the plurality of cradle arms to prevent lateral disengagement.

A pair of upright members 52 is coupled to the cross top side 18 of the cross member. The pair of upright members 52 may be parallel and vertical. A plurality of pulleys 54 is coupled to the pair of upright members 52. Each of the plurality of pulleys 54 may be vertically oriented. A winch 56 is coupled to the hitch bracket 12. The winch 56 has a motor 58 and a cable 60. The cable 60 is in operational communication with a topmost pulley 62 of the plurality of pulleys and one of the other pulleys 54 of the plurality of pulleys. The plurality of pulleys 54 may be evenly spaced along the pair of upright members 52 allowing the user to select the desired height to draw the barbed wire 48. There may be six pulleys 54 each ten inches apart.

A control box 64 is coupled to the pair of upright members 52. The control box 64 is in operational communication with the motor 58 of the winch and is configured to be in operational communication with a battery of the vehicle 14. The control box 64 is configured to be in operational communication with a controller to selectively extend or retract the cable 60.

A wire gripper 66 is coupled to the winch 56. The wire gripper 66 is in operational communication with a distal end 68 of the cable and is configured to secure the barbed wire 48. The wire gripper 66 may include a tapered gripper body 70 and a gripper attachment ring 72 coupled to the gripper body 70. The gripper body 70 may terminate in a body ring 74 attached to a carabiner 76 to easily engage or disengage the distal end 68 of the cable.

A pair of stabilizers 78 is coupled to the cross member 16. The pair of stabilizers 78 is coupled adjacent the cross left end 22 and the cross right end 24. Each stabilizer 78 may have an adjustment sleeve 80 with a plurality of adjustment apertures 82 and a leg 84 slidably engaged within the adjustment sleeve 80. The leg 84 has a circular foot portion 86 for added stability and can be fixed within the adjustment sleeve 80 with a pin extending through one of the adjustment apertures 82.

In use, the hitch bracket 12 is engaged with the vehicle 14. The rolls of barbed wire 48 are loaded onto the pair of spindles 42 which are then engaged with the plurality of cradle arms 30. The barbed wire 48 is wrapped and stapled to a post or tree and then unwound as the vehicle 14 is driven to the next post or tree. The barbed wire 48 is engaged with the wire gripper 66 and the winch 56 is activated to pull the barbed wire 58 taut while it is stapled and tied to the post or tree. For subsequent strands of the barbed wire 58 the cable 60 is engaged with the sequentially lower pulley 54 of the plurality of pulleys.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A barbed wire installation apparatus comprising:

a hitch bracket, the hitch bracket being configured to be selectively engageable with a hitch receiver of a vehicle;

a horizontal cross member coupled to the hitch bracket, the cross member being oriented perpendicularly to the hitch bracket, the cross member having a cross top side, a cross bottom side, a cross left end, a cross right end, a cross front side, and a cross back side;

a plurality of cradle arms coupled to the cross member, the plurality of cradle arms extending above the cross top side, the plurality of cradle arms including a left pair of cradle arms and a right pair of cradle arms;

a pair of spindles coupled to the plurality of cradle arms, the pair of spindles including a left spindle and a right spindle rotatably coupled to the left pair of cradle arms and the right pair of cradle arms, respectively, each spindle being configured to secure a roll of barbed wire;

a pair of upright members coupled to the cross member, the pair of upright members being coupled to the cross top side;

a plurality of pulleys coupled to the pair of upright members;

a winch coupled to the hitch bracket, the winch having a motor and a cable, the cable being in operational communication with a topmost pulley of the plurality of pulleys and one of the other pulleys of the plurality of pulleys;

a control box coupled to the pair of upright members, the control box being in operational communication with the motor of the winch and being configured to be in operational communication with a battery of the vehicle; and a wire gripper coupled to the winch, the wire gripper being in operational communication with a distal end of the cable, the wire gripper being configured to secure the barbed wire.

2. The barbed wire installation apparatus of claim 1 further comprising a pair of stabilizers coupled to the cross member, the pair of stabilizers being coupled adjacent the cross left end and the cross right end.

3. The barbed wire installation apparatus of claim 2 further comprising each stabilizer having an adjustment sleeve with a plurality of adjustment apertures and a leg slidably engaged within the adjustment sleeve, the leg having a circular foot portion.

4. The barbed wire installation apparatus of claim 1 further comprising the pair of upright members being parallel and vertical.

5. The barbed wire installation apparatus of claim 1 further comprising each cradle arm having an extension portion extending at an angle from the cross top side, an end portion oriented perpendicularly to the extension portion, and a stopper portion extending vertically from the extension portion; each spindle being selectively engageable between the end portion and the stopper portion.

6. The barbed wire installation apparatus of claim 5 further comprising each spindle having a pair of stopper discs, the pair of stopper discs being positioned to rest outside of the stopper portions of the plurality of cradle arms and prevent lateral disengagement.

7. The barbed wire installation apparatus of claim 5 further comprising the extension portion being oriented between 30° and 60° to horizontal.

8. The barbed wire installation apparatus of claim 1 further comprising each of the plurality of pulleys being vertically oriented.

9. The barbed wire installation apparatus of claim 1 further comprising the wire gripper including a tapered gripper body, and a gripper attachment ring coupled to the gripper body.

10. A barbed wire installation apparatus comprising:

a hitch bracket, the hitch bracket being configured to be selectively engageable with a hitch receiver of a vehicle;

a horizontal cross member coupled to the hitch bracket, the cross member being oriented perpendicularly to the hitch bracket, the cross member having a cross top side, a cross bottom side, a cross left end, a cross right end, a cross front side, and a cross back side;

a plurality of cradle arms coupled to the cross member, the plurality of cradle arms extending above the cross top side, the plurality of cradle arms including a left pair of cradle arms and a right pair of cradle arms, each cradle arm having an extension portion extending at an angle from the cross top side, an end portion oriented perpendicularly to the extension portion, and a stopper portion extending vertically from the extension portion, the extension portion being oriented between 30° and 60° to horizontal;

a pair of spindles coupled to the plurality of cradle arms, the pair of spindles including a left spindle and a right spindle rotatably coupled to the left pair of cradle arms and the right pair of cradle arms, respectively, each spindle being configured to secure a roll of barbed wire, each spindle being selectively engageable between the end portion and the stopper portion, each spindle having a pair of stopper discs, the pair of stopper discs being positioned to rest outside of the stopper portions of the plurality of cradle arms and prevent lateral disengagement;

a pair of upright members coupled to the cross member, the pair of upright members being coupled to the cross top side, the pair of upright members being parallel and vertical;

a plurality of pulleys coupled to the pair of upright members, each of the plurality of pulleys being vertically oriented;

a winch coupled to the hitch bracket, the winch having a motor and a cable, the cable being in operational communication with a topmost pulley of the plurality of pulleys and one of the other pulleys of the plurality of pulleys;

a control box coupled to the pair of upright members, the control box being in operational communication with the motor of the winch and being configured to be in operational communication with a battery of the vehicle;

a wire gripper coupled to the winch, the wire gripper being in operational communication with a distal end of the cable, the wire gripper being configured to secure the barbed wire, the wire gripper including a tapered gripper body, and a gripper attachment ring coupled to the gripper body; and a pair of stabilizers coupled to the cross member, the pair of stabilizers being coupled adjacent the cross left end and the cross right end, each stabilizer having an adjustment sleeve with a plurality of adjustment apertures and a leg slidably engaged within the adjustment sleeve, the leg having a circular foot portion.

* * * * *